United States Patent [19]

Adams

[11] Patent Number: 4,741,842

[45] Date of Patent: May 3, 1988

[54] PARTICULATE DETERGENT SOFTENER COMPOSITIONS COMPRISING A MIXTURE OF CATIONIC SOFTENER AND ETHOXYLATED AMINE

[75] Inventor: Richard P. Adams, Kendall Park, N.J.

[73] Assignee: Colgate-Palmolive Company, New York, N.Y.

[21] Appl. No.: 823,644

[22] Filed: Jan. 27, 1986

[51] Int. Cl.[4] ..... C11D 1/62; C11D 3/26

[52] U.S. Cl. ..... 252/8.75; 252/8.8; 252/528; 252/547; 252/548; 252/529; 252/539

[58] Field of Search ..... 252/8.75, 8.8, 528, 252/547, 529, 548

[56] References Cited

U.S. PATENT DOCUMENTS

| | | | |
|---|---|---|---|
| 3,154,489 | 10/1964 | Du Brow et al. | 252/8.75 |
| 3,936,537 | 2/1976 | Baskerville et al. | 427/242 |
| 4,320,013 | 3/1982 | Lohman | 252/8.8 |
| 4,338,204 | 7/1982 | Spadini | 252/8.75 |
| 4,395,342 | 7/1983 | Strauss | 252/8.75 |
| 4,439,330 | 3/1984 | Ooms | 252/8.8 |
| 4,627,927 | 12/1986 | Sakatani et al. | 252/8.75 |
| 4,659,487 | 4/1987 | May et al. | 252/8.8 |

FOREIGN PATENT DOCUMENTS

| | | |
|---|---|---|
| 12231 | 12/1984 | European Pat. Off. . |
| 3150179 | 6/1983 | Fed. Rep. of Germany . |
| 6294 | 1/1984 | Japan . |
| 2133813 | 8/1984 | United Kingdom . |
| 2157729 | 10/1985 | United Kingdom . |

*Primary Examiner*—Prince E. Willis

*Attorney, Agent, or Firm*—N. Blumenkopf; H. S. Sylvester; M. M. Grill

[57] ABSTRACT

Particulate heavy duty detergent compositions, particularly for imparting improved softness and detersive effects to fabrics laundered therewith, include in addition to conventional builder and principally anionic surfactant components, particulate cationic softener of the di-lower-di-higher alkyl quaternary ammonium and/or heterocyclic imide type, e.g. imidazolinium, in admixture with an ethoxylated tertiary amine softener/dispersing agent, such as N-tallow tertiary amine ethoxylated with from about 2 to 15 moles of ethylene oxide. The cationic softener-ethoxylated amine mixture is in the form of a spaghetti, flake, or other shape and is present in the product composition as substantially homogeneously dispersed, discrete particles. A process of laundering fabrics using the above-mentioned composition is also described.

19 Claims, No Drawings

PARTICULATE DETERGENT SOFTENER COMPOSITIONS COMPRISING A MIXTURE OF CATIONIC SOFTENER AND ETHOXYLATED AMINE

The present invention relates to detergent compositions and in particular to detergent-softener compositions capable of imparting improved softness, detersive effects, soil anti-redeposition and antistatic properties to fabrics treated therewith and particularly in a machine laundering process.

Compositions for simultaneously achieving detergency and an appreciable level of softness in the machine laundering of fabrics, and thus suitable for use in the wash cycle, are well-known and widely available commercially. The fugitive interaction between anionic surfactant, perhaps the most commonly used of the available types of surfactants, and cationic softeners particularly those of the di-lower-di-higher alkyl quaternary ammonium type, is likewise well recognized in the patent literature. Such interaction often results in the formation of unsightly precipitates which become entrapped within or otherwise deposit upon the fabric being washed. Discoloration or other aesthetically displeasing effects are for the most part inevitable. The net result is often a depletion in the effective amount of anionic surfactant available for useful purposes since the loss of anionic surfactant is the primary consequence of this interaction.

Although the most effective types of cationic quaternary ammonium softeners, as exemplified by the aforementioned di-higher alkyl type quaternary compounds, such as distearyl dimethyl ammonium chloride, can function in the wash cycle in the presence of anionic surfactant, builder, etc., the quantity needed to achieve effective softening is usually coterminous with amounts promotive of undesired cationic-anionic interaction. As a general rule, at least about twice as much cationic surfactant is required for softening as for antistatic activity. Representative prior art for dealing with this problem are discussed below.

In U.S. Pat. No. 3,325,414, which deals primarily with detergents of controlled foam or sudsing capability, the cationic-anionic problem and attendant detrimental effects are discussed in detail. The patent additionally points out that certain quaternary ammonium compounds, among the class of cationic agents, are generally unstable when heated and when in contact with alkaline builders, the instability being manifested by the development of strong amine odors and undesirable color. The compositions of that patent are limited to the use of quaternary ammonium halides having but one higher alkyl group, the given structural formula for the cationic material being correspondingly limited. Cationics of this type are markedly inferior to the di-higher alkyl types at least insofar as fabric softening activity is concerned.

The problem of cationic incompatibility in anionic detergents is also acknowledged in U.S. Pat. Nos. 3,936,537 and 4,141,841 and it is therein proposed to employ as an essential ingredient in combination with the cationic substance an organic dispersion inhibitor. An important characteristic of such inhibitors is a maximum water solubility at 25° C. of 50 ppM. Similar disclosures may also be found in U.S. Pat. Nos. 4,113,630; 4,196,104 and 4,272,386. In U.S. Pat. No. 4,230,590 to Wixon heavy duty detergents comprising conventional builder, principally anionic surfactant components, cationic softener and a mixture of fatty acid soap and cellulose ether are disclosed. The soap-cellulose ether mixture is in the form of spaghetti, flake or other shape and is present in the composition as substantially homogeneously dispersed, discrete particles.

In U.S. Pat. No. 4,298,480 to Wixon heavy duty detergents having compositions similar to that described in the preceding paragraph with the exception that cellulose ether is excluded therefrom are disclosed.

In U.S. Pat. No. 4,329,237 to Wixon, heavy duty detergents also similar to those in the preceding two paragraphs are described except that the particles of soap are in admixture with nonionic surfactant.

In U.K. Patent Application GB 2,133,813A to Taha, published Aug. 1, 1984, further improvements in the above-mentioned patents to Wixon—manifested by less greasy staining (spot staining) due, for example, to the cationic softener—are provided by including in addition to and homogeneously dispersed throughout the anionic surfactant and detergent builder discrete particles (e.g. prills) of a mixture of the cationic amine softener and nonionic organic surfactant.

See also Wixon's U.S. Pat. Nos. 4,339,335; 4,326,971; 4,416,811; 4,411,803 and 4,450,085 and U.S. Pat. No. 4,414,129 to Joshi, all of which disclose granular or powdery detergent-softener compositions.

Although the above-mentioned detergent/soap and cationic softener containing detergent compositions possess desirable softening, antistatic, and detersive properties, still further improvements in these properties are desired while at the same time reducing overall cost of the product.

The present invention provides stable detergent softener compositions capable of providing improved softness without staining, detergency, antistatic and soil antiredeposition properties to fabrics treated therewith in a laundering process in cold or hot water. The compositions generally comprise by weight from about 5 to 40% of a water-soluble, non-soap, anionic surfactant, from about 10 to 60% of water-soluble, neutral to alkaline builder salt, and substantially homogeneously dispersed in said composition as discrete particles an intimate mixture of (i) from about 2 to 20% by weight of the composition of a cationic amine softener, such as (a) aliphatic, di-(lower$C_1$–$C_4$ alkyl, di-(higher)$C_{14}$–$C_{24}$ alkyl quaternary ammonium salts, (b) heterocyclic compounds, and mixtures of (a) and (b), with (ii) a water-soluble ethoxylated tertiary amine compound dispersant-/softener compound (preferably 2 to 50% by weight based on weight of cationic softener (i)), the percent concentration of anionic surfactant being at least about (1.5Cs+5), Cs representing the percent concentration of the total softeners (i) and (ii).

In certain other aspects, the invention includes both the processes of formulating and using the aforedescribed compositions.

As described in the aforementioned U.K. application GB 2,133,813A, adding the cationic material in intimate admixture with nonionic organic surfactant in flakes, granules and the like form, has the advantage that the spot staining of the clothes after drying is substantially mitigated. Since the nonionic surfactant functions as a dispersing agent to promote the uniform dispersion of the cationic softener and hence uniform deposition of the softener on the treated fabrics, the nonionic surfactant also contributes to uniform softness and to soil antiredeposition, especially in non-phosphate formulas.

However, the nonionic ethoxylated fatty alcohol dispersant does not, per se, contribute to increase the level of softness imparted by the cationic fabric softener. Although the reason for the failure of the nonionic dispersant to provide an enhanced softening benefit has not been fully understood, it is believed that the reason may be that the nonionic dispersant is not substantive to, i.e. does not bond or attach to, the laundered fabrics.

There are many known types and classes of fabric softening compounds, primarily nitrogen-containing compounds, such as the quaternary ammonium salt and imidazolinium salt compounds. Nevertheless, in order for a softening active compound to be a candidate for replacing the "non-active" dispersant in the post-added softener particles, e.g. prills, of the U.K. application, it must satisfy several different criteria. Thus, the softening compound must also function as a dispersant for the finely divided particles of cationic fabric softener compound once the prills are added to the wash bath and must promote solubilization or disintegration of the prills upon introduction into the wash bath. The successful candidate softener/dispersant compound must also, naturally, be compatible with, i.e. non-reactive with, the cationic fabric softener and must also be processible into the prills, or other discrete particle form, and must be compatible with the detergent, builder, and other ingredients of the detergent composition. The nonionic surfactant/dispersant replacement compound should also contribute to, or at least not adversely effect, antistatic property of the overall detergent composition.

The present invention is based on the discovery that by replacing the ethoxylated alcohol nonionic surfactant/dispersant with an equivalent amount of an ethoxylated tertiary amine, the total amount of the cationic softener—in the form of its mixture with the ethoxylated amine—can be substantially reduced without a corresponding reduction in softness imparted to treated fabrics, and in some cases with an increase in softness. There is also no adverse impact on antistatic property of treated fabrics. While the overall detersive, softness, antistatic and antiredeposition properties are improved or not adversely effected, the ability to lower the amount of the cationic amine compound softener, which is typically the highest cost active ingredient in the formulation, results in a quite substantial cost saving.

Cationic softeners useful herein are conveniently known materials and are of the high-softening type. Included are the N,N-di-(higher)$C_{14}$–$C_{24}$, N,N-di(-lower)$C_1$–$C_4$ alkyl quaternary ammonium salts with water solubilizing anions, such as halide, e.g. chloride, bromide and iodide; sulphate, methosulphate and the like and the heterocyclic imides such as imidazolinium compounds.

For convenience, the aliphatic quaternary ammonium salts may be structurally defined as follows:

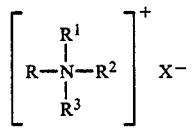

wherein R and $R^1$ each represent an alkyl group of 14 to 24 and preferably 14 to 22 carbon atoms;

$R^2$ and $R^3$ each represent a lower alkyl group of 1 to 4 and preferably 1 to 3 carbon atoms, X represents an anion capable of imparting water solubility or dispersibility including the aforementioned chloride, bromide, iodide, sulphate and methosulphate anions.

Particularly preferred species of aliphatic quaternary compounds include:

distearyl dimethylammonium chloride,
di-hydrogenated tallow dimethyl ammonium chloride,
di-tallow dimethyl ammonium chloride,
distearyl dimethyl ammonium methyl sulphate, and
di-hydrogenated tallow dimethyl ammonium methyl sulphate.

Heterocyclic imide softeners of the imidazolinium type may also be used and can be structurally defined as follows:

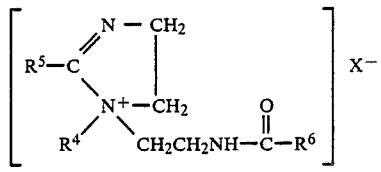

wherein $R^4$ represents a lower alkyl group of 1 to 4 and preferably 1 to 3 carbons; $R^5$ and $R^6$ each represent substantially linear higher alkyl groups of about 13 to 23 and preferably 13 to 19 carbons and X has the aforedefined significance. Particularly preferred species of imidazoliniums include:

1-methyl-1-tallow amido ethyl-2-tallow imidazolinium methyl sulphate; available commercially from Sherex Chemical Co. under the tradename Varisoft (Registered Trademark) 475 as a liquid, 75% active ingredient in isopropanol solvent, 1-methyl-1-oleyl amido ethyl-2-oleyl imidazolinium methyl sulphate; available commercially from Sherex Chemical Co. under the tradename Varisoft (Registered trademark) 3690, 75% active ingredient in isopropanol solvent.

Mixtures of these cationic fabric softeners can be used, including mixtures of quaternary ammonium salt and imidazolinium salt.

The ethoxylated amine compounds found to be useful herein are the ethoxylated tertiary amine compounds which can be represented by the following formula:

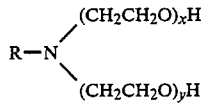

where R is a fatty organic substituent, and x and y are positive numbers such that the sum x+y is from about 2 to about 15.

As examples of the fatty organic substituent R, preferred are alkyl or alkenyl groups, which may be linear or branched (linear preferred), and which may have from about 8 to about 22 carbon atoms, preferably from about 12 to 20 carbon atoms. The sum x+y is preferably from about 5 to about 15. Specific examples of suitable R groups include decyl, dodecyl, stearyl, tallow, hydrogenated tallow, dodecyl, myristyl, oleyl and the like, usually derived from the corresponding higher fatty acid. Generally, mixtures of different alkyl chain lengths will be used, such as $C_{12}$–$C_{15}$, $C_{14}$–$C_{16}$, $C_{16}$–$C_{18}$, $C_{18}$–$C_{20}$, and so on. Stearyl, tallow and hydrogenated tallow compounds are readily commercially available, such as, for example, the Ethomeen® series from Armak Chemical Co., e.g. Ethomeen T/25 (R=tallow, x+y=15); Ethomeen T/15 (R=tallow, x+y=5); Ethomeen 18/15 (R=octadecyl (stearyl), x+y=5); and the Varonic® series from Sherex Chemicals, e.g. Varonic T-215 (R=tallow, x+y=15); Varonic T-210 (R=tallow, x+y=10); Varonic U215 (R=mixed cetyl/stearyl, x+y=15); Varonic U205 (R=mixed cetyl/stearyl, x+y=5), and are preferred for use herein in view of their high performance levels and relatively low cost.

In this invention, the ethoxylated fatty amines provide the dual function as a dispersant for the cationic fabric softener, equivalent to the function of the ethoxylated fatty alcohol nonionic surfactant in the compositions of the aforementioned U.K. application of Taha, and also as a softening active nitrogen compound, per se. In view of this additional softening benefit, the total amount of cationic fabric softener post-added to the detergent powder composition can be reduced at the same total level of softener active compounds (cationic softener plus ethoxylated amine) to provide about the same softness and antistatic performance, or the amount of post-added softener/antistatic granules, prills, etc., can be maintained at the same level to provide further enhancement in softening and antistatic performance.

The cationic-nonionic mixture is preferably prepared in prilled form. The prills are produced by spray cooling a liquefied mixture of the cationic and the ethoxylated amine. In the most preferred embodiment, a liquid ethoxylated amine is used and this is added to the melted cationic. A typical cationic is Arosurf TA-100 (dimethyl distearyl ammonium chloride) and as supplied this material forms a very fluid liquid when melted and heated to 90° C. The liquid mixture of cationic ethoxylated amine in another preferred embodiment may be allowed to cool to room temperature or as necessary to solidify. The solid may then be ground to desired particle size and post added to the other detergent ingredients.

Alternatively, the cationic and ethoxylated amine, when combined, may be first mixed in the desired amounts to form a substantially homogeneous mass which can be worked, according to well known techniques until it is sufficiently "doughy" or plastic to be in suitable form for, preferably, extrusion or other process, e.g. pelleting, granulation, stamping or pressing. Working may be effected, for example, by roll milling, although this is not essential, followed by extrusion in a conventional soap plodder with the desired type of extrusion head. The latter is selected in accordance with the shape, i.e. geometric form, desired in the extrudate. Extrusion in the form of spaghetti or noodles is preferred. Other shaped forms such as flakes, tablets, pellets, ribbons, threads and the like are suitable alternatives. Special extruders for the foregoing purposes are well known in the art and include, for example, Elanco models EXD-60; EXCD-100; EX-130 and EXD-180, a Buhler extruder and the like. Generally, the spaghetti extrudate is a form-retaining mass, i.e. semi-solid and essentially non-tacky at room temperature requiring in most cases no further treatment such as water removal. If necessary, the latter can be effected by simple drying techniques. The spaghetti should have an average length of from about 2 to 20 mm with about 95% thereof within a tolerance of 0.5 to 20 mm and an average diameter or width of from about 0.2 to 2.00 mm with a range of 0.4 to 0.8 mm being preferred. The bulk density of the spaghetti will usually be from about 0.9 to 1.3 g/cm$^3$. Flakes will measure about 4 mm in length and breadth and 0.2 mm in thickness, pellets have a cross-section of 2.5 mm while tablets have a cross-section of 2.5 mm and thickness of 2.5 mm.

Generally, from 1 to 20% by weight of ethoxylated amine based on the weight of the cationic softener is contemplated. Preferably, the ethoxylated amine should be used in amounts of from 5 to 15% with about 8–9% being particularly preferred.

Although surfactants of conventional type can be used herein, it is preferred that at least about 90% and preferably at least about 95% of the total surfactant or detergent be of the anionic type, these materials being particularly beneficial in heavy duty detergents for fabric washing. Anionics for use herein generally include the water soluble salts of organic reaction products having in their molecular structure an anionic solubilizing group such as $SO_4H$, $SO_3H$, COOH and $PO_4H$ and an alkyl or alkyl group having about 8 to 22 carbon atoms in the alkyl group or moiety. Suitable detergents are anionic detergent salts having alkyl substituents of 8 to 22 carbon atoms such as: water soluble sulphated and sulphonated anionic alkali metal and alkaline earth metal and detergent salts containing a hydrophobic higher alkyl moiety, such as salts of higher alkyl mono- or poly-nuclear aryl sulphonates having from about 8 to 18 carbon atoms in the alkyl group which may have a straight (preferred) or branched chain structure. Preferred species include, without necessary limitation: sodium linear tridecylbenzene sulphonate, sodium linear dodecyl benzene sulphonate, sodium linear decyl benzene sulphonate, lithium or potassium pentapropylene benzene sulphonate; alkali metal salts of sulphated condensation products of ethylene oxide, e.g. containing 3 to 20 and preferably 3 to 10 moles of ethylene oxide, with aliphatic alcohols containing 8 to 18 carbon atoms or with alkyl phenols having alkyl groups containing 6 to 18 carbon atoms, e.g. sodium nonyl phenol pentaethoxamer sulphate and sodium lauryl alcohol triethoxamer sulphate; alkali metal salts of saturated alcohols containing from about 8 to 18 carbon atoms, e.g. sodium lauryl sulphate and sodium stearyl sulphate; alkali metal salts of higher fatty acid esters of low molecular weight alkylol sulphonic acids, e.g. fatty acid esters of the sodium salt of isethionic acid; fatty ethanolamide sulphates; fatty acid amides of amino alkyl sulphonic acids. e.g. lauric acid amine of taurine; alkali metal salts of hydroxy alkane sulphonic acids having 8 to 18 carbon atoms in the alkyl group, e.g. hexadecyl, alphahydroxy sodium sulphonate. The anionic surfactant or mixture thereof is desirably used in the form of its alkali or alkaline earth metal salts. The anionic surfactant is preferably of the non-soap type. However, minor amounts of soap, e.g. up to about 35% and preferably 20% based on total anionic can be added, for example, to the crutcher mix.

The concentration of non-soap anionic surfactant should preferably be selected so as to provide an excess with respect to cationic-softener according to the empirical relationship:

$$\% \text{ concentration} = 1.5Cs + 5$$

wherein Cs is the percent concentration of cationic softener. This assures the minimum excess of anionic necessary for optimum overall detergency, softening, etc., performance in the product composition.

Minor amounts of other types of detergents can be included along with the anionic surfactant, their sum in any case not exceeding about 10% and preferably about 2–5% of total detergent, i.e. such other detergent plus non-soap anionic. Useful here are the nonionic surface active agents which contain an organic hydrophobic group and a hydrophilic group which is a reaction product of a solubilizing group such as carboxylate, hydroxyl, amido or amino with ethylene oxide or with the polyhydration product thereof, polyethylene glycol. Included are the condensation products of $C_8$ to $C_{30}$ fatty alcohols such as tridecyl alcohol with 3 to 100 moles ethylene oxide; $C_{16}$ to $C_{18}$ alcohols with 11 to 50 moles of ethylene oxide; ethylene oxide adducts with monoesters of polyhydric, e.g. hexahydric alcohol; condensation products of polypropylene glycol with 3 to 100 moles of ethylene oxide; the condensation products of alkyl ($C_6$ to $C_{20}$ straight or branched chain) phenols with 3 to 100 moles of ethylene oxide and the like.

Suitable amphoteric detergents generally include those containing both an anionic group and a cationic group and a hydrophobic organic group which is preferably a higher aliphatic radical of 10 to 20 carbon atoms; examples include the N-long chain alkyl aminocarboxylic acids and the N-long chain alkyl iminodicarboxylic acids such as described in U.S. Pat. No. 3,824,189.

The compositions herein preferably include water soluble alkaline to neutral builder salt in amounts of from about 10 to 60% by weight of total composition. Useful herein are the organic and inorganic builders including the alkali metal and alkaline earth metal phosphates, particularly the condensed phosphates such as the pyrophosphates or tripolyphosphates, silicates, borates, carbonates, bicarbonates and the like. Species thereof include sodium tripolyphosphate, trisodium phosphate, tetrasodium pyrophosphate, sodium acid pyrophosphate, sodium monobasic phosphate, sodium dibasic phosphate, sodium hexametaphosphate; alkali metal silicates such as sodium metasilicate, sodium silicates, e.g. with $Na_2O/SiO_2$ ratios of 1.6:1 to 3.2:1, preferably 1:6 to 1:3.4, more particularly 1:2 to 1:3, such as 1:2.4, sodium carbonate, sodium sulphate, borax (sodium tetraborate), ethylene diamine tetraacetic acid tetrasodium salt, trisodium nitriloacetate and the like and mixtures of the foregoing. The builder salt may be selected so as to provide either phosphate-containing or phosphate-free detergents. As to the latter embodiments, sodium carbonate is particularly effective. Another material found to provide good detergency effects is metakaolin which is generally produced by heating kaolinite lattice to drive off water producing a material which is substantially amorphous by X-ray examination but which retains some of the structural order of the kaolinite. Discussions of kaolin and metakaolin are found in U.S. Pat. No. 4,075,280 columns 3 and 4 and Grimshaw, "The Chemistry and Physics of Clays and Allied Ceramic Materials," (4th edition, Wiley-Interscience), pages 723–727. Metakaolin is also the subject of U.S. patent application Ser. Nos. 905,622 and 905,718, the relevant disclosures of which are herein incorporated by reference. The metakaolin also appears to have softening utility. As to the latter, the most effective metakaolins appear to be those which behave best in the reaction with sodium hydroxide to form zeolite 4A as described in U.S. Pat. No. 3,114,603 which refers to such materials as "reactive kaolin." As explained in the referenced sources, metakaolin is an aluminosilicate. The metakaolin and/or a zeolite is included in about the same amounts as the builder salt, and preferably supplemental thereto, e.g. zeolite:silicate in a ratio of 6:1. A particularly useful form of the metakaolin is that available commercially as Satintone No. 2.

Preferred optional ingredients useful herein include perfume as Genie perfume; optical brighteners and blueing agents which may be dyes or pigments, suitable materials in this regard including stilbene and Tinopal 5BM brighteners and particularly in combination and Direct Brilliant Sky Blue 6B, Solophenyl Violet 4BL, Cibacete, Brilliant Blue RBL and Cibacete Violet B, Polar Brilliant Blue RAW and Calcocid Blue 2G blueing agents. The brightener may be included in amounts ranging up to about 1% of the total composition while blueing agents may range up to about 0.1%, preferably up to about 0.01% of total composition. Blueing agents, e.g. Polar Brilliant Blue, may be included in the cationic prill. In either case, the amount need only be minimal to be effective.

Other ingredients of optimal significance include bleaching agents which may be of the oxygen or chlorine liberating type; oxygen bleaches include sodium and potassium perborate, potassium monopersulphate and the like, while chlorine bleaches are typified by sodium hypochlorite, potassium dichloroisocyanurate, trichloroisocyanurate acid and the like. The latter chlorine-liberating bleaches are representative of the broad class of water soluble, organic, dry solid bleaches known as the N-chloro imides including their alkali metal salts. These cyclic imides have from about 4 to 6 members in the ring and are described in detail in U.S. Pat. No. 3,325,414. Each of the oxygen and chlorine type bleaches discussed above are fully compatible with the compositions herein and have good stability in the presence of the anionic and cationic components. They are generally used in proportions ranging from about 0.1 to 45% by weight of total solids or from about 0.05% to about 40% based on total detergent composition.

Yet additional optional ingredients include water soluble and/or dispersible hydrophobic colloidal cellulosic soil suspending agent. Methyl cellulose, e.g. Methocel (Registered Trademark) and carboxymethyl cellulose (CMC) are particularly effective. Polyvinyl alcohol is likewise effective and especially in the washing of cotton and synthetic fibers, such as nylon, dacron and resin treated cotton. The additional soil suspending agent may be included in amounts up to about 2% based on total solids and up to about 4% based on total detergent composition.

Fillers may also be included in addition to the aforementioned ingredients, such as sodium sulphate, sodium chloride and the like. The amount will range up to about 40% of total composition.

The detergent composition is prepared by conventional processing, such as spray drying a crutcher mix of surfactant, builder, filler, etc., without volatile ingredients such as perfume or ingredients otherwise adversely affected by the spray drying process such as peroxygen bleach, e.g. sodium perborate. Ingredients of this type are preferably post blended. As previously mentioned, the cationic softener/ethoxylated amine mixture is simply dry blended with the dried detergent in particulate form by simple mechanical mixing which is more than adequate to achieve a homogeneous product. A typical procedure would be as follows: water is added to a crutcher followed in order by anionic surfactant, sodium silicate, optional ingredients where used such as Satintone No. 2 and filler such as sodium sulphate and builder salt. The crutcher mixture is heated to about 140° F. (60° C.) before addition of builder, e.g. sodium tripolyphosphate and the solids content of the crutched mixture before spray drying is about 55–65%. Spray drying may be carried out in a conventional manner by pumping the hot mixture from the crutcher to a spray tower where the mixture passes through a spray nozzle into a hot evaporative atmosphere. Bleach and other materials remaining to be added are incorporated into the cooled, dried detergent mass by any suitable means such as simple mechanical mixing.

In use, sufficient of the detergent composition is added to the wash cycle to provide a concentration of cationic softener in the wash medium of about 1.5 to 8.0 g/3500 g laundry with a range from about 70° F. (21° C.) to the boil (i.e. about 212° F. (100° C.)). In this connection, it is understood that by "cold" wash, is meant a washing temperature of up to 70° F. (21° C.), "warm" is from about 70° F. (21° C.) to boiling.

Certain types of aliphatic quaternary ammonium compounds though relatively ineffective as regards softening are nevertheless quite effective as antistatic agents in the compositions herein and particularly since they are physically compatible with anionic surfactants in liquid environments. In general, such materials encompass the ethoxylated and/or propoxylated quaternary ammonium compounds of the following formula:

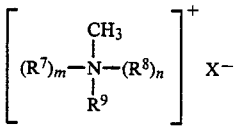

wherein $R^7$ and $R^8$ each represent an ethoxy or propoxy group, m and n are integers of from 1 to 50 and may be the same or different and $R^9$ represents an alkyl group of 14 to 24 carbon atoms, and X is as defined above. Compounds of this type include (a) methylbis(2-hydroxy-ethyl) coco ammonium chloride, a liquid 75% active ingredient in isopropanol/water solvent and available commercially as Ethoquad (Registered Trademark) c/12, Armak and Variquat (Registered trademark) 638, Sherex Chemical Co.; (b) Ethoquad c/25—same as in (a) but having 15 moles of ethylene oxide (each of $R^7$ and $R^8$—m and n each—15) and available as 95% active ingredient; (c) methylbis(2-hydroxyethyl)octadecyl ammonium chloride, a liquid, 75% active ingredient in isopropanol/water solvent available commercially as Ethoquad 8/12, Armak and (d) same as (c) but having 15 moles of ethylene oxide (each of $R^7$ and $R^8$—m and n each =15), a liquid, 95% active ingredient and available commercially as Ethoquad 18/15, Armak. These materials can be used in amounts ranging up to about 10% by weight of the total composition.

The present invention may be put into practice in various ways and a number of specific embodiments will be described to illustrate the invention with reference to the accompanying examples in which all parts and percentages are by weight.

EXAMPLE 1A AND EXAMPLE 1B (A) 88 parts of powdered Arosurf TA (dimethyl distearyl ammonium chloride) are heated to 90° C. and a fluid melt results. To this melt are added 8 parts of Ethomeen T-25, 1 part calcium silicate and 3 parts moisture. The mixture is stirred well and then cooled to room temperature. A white solid results. The solid is then ground to a powder (on U.S. No. 8 Sieve 0% through, U.S. No 100 Sieve less than 10% through; a No. 8 sieve has openings 2.38 mm across, a 100 sieve 149 microns across). The product resembles the original Arosurf powder.

(B) Example 1A and Example 1BA is repeated except that 8 parts of an ethoxylated fatty alcohol nonionic dispersant is used in place of the ethoxylated amine.

EXAMPLE 2

A spray dried heavy duty detergent having the following composition is provided:

| Component | Weight % |
|---|---|
| Linear tridecyl benzene sulphonate (LTBS) | 14.5 |
| Sodium tripolyphosphate (NaTPP) | 26.0 |
| Silicate (1:2.4) | 6.8 |
| $Na_2CO_3$ | 4.8 |
| Brightener (Stilbene and Tinopal 5 BM) | 0.34 |
| Borax | 1.0 |
| Methocel | 0.5 |
| Carboxymethyl cellulose | 0.24 |
| Sodium sulphate and water | q.s. 100 |
| | 100.00 |

To 100 g of the above composition are added 4.1 grams (4.1%) of the cationic powder of Example 1A or 4.5 grams (4.5%) of the cationic powder of Example 1B to obtain compositions 2A and 2B, respectively. Each of compositions 2A and 2B are tested for softness and antistatic properties. The results are shown in Table A. Softness is determined under the following conditions:

A fabric load (total weight about 1.5 pounds) consisting of four terry cloth towels, three 15"×15" swatches of each of the following seven fabric types: Banlon, Dacron double knit (DDK), Dacron/Cotton blend (65/35), cotton percale, Acetate Jersey (AJ), Nylon tricot, and Dacron polyester single knit (DSK), and 10 swatches of each of three different soiled fabrics (spinach on 50-50 Dacron/cotton; sebum on DDK and Piscataway clay on 50/50 Dacron/cotton) is washed at 100° F. with 17 gallons wash water (150 ppm) in a Maytag washing machine using 100 grams of cleaning composition. After a single wash cycle, the fabric load is dried in a commercially available tumbler drier for about 30 minutes and left to cool for about 2 hours.

Six experienced testers are used to evaluate the softness of the towels treated with each test formulation by one of two methods: for each test composition, each of the four towels is rated against each of the towels treated with each of the other test compositions (in four separate groupings) and rated in order from softest to harshest; or each of the four towels for each test composition is rated on a scale of 1 (no softening) to 10 (excellent softness) and an average of the four values is taken as the softness number. In the former test (softening by comparison) for each test formulation, the total number of first places (1 point), second places (2 points), third places (3 points) and so on are added up and the lowest total corresponds to the best softening performance. In the latter test (sliding scale), the average softness number for each tester is averaged with the softness number assigned by the other testers to arrive at a single softness number, the higher the number the better the softening performance. Either of these methods has been found to be a statistically significant and reliable procedure for evaluating softness.

Antistatic performance is determined by measuring the static charge (voltage) buildup on swatches of four different fabrics: Dacron/Cotton (65/35); Dacron Double Knit (DDK); Acetate Jersey (AJ) and Banlon polyester, washed as described above. Each of the 3 washed and machine dried swatches of each of the 4 different fabrics is clipped onto a holding frame. A small wool swatch attached to the outer rim of a rotating circular holder is rotated on the holder in contact with the fabric swatch for 5 seconds. The temperature is maintained at 70°-72° F. and the relative humidity at 21%. The voltages for each fabric (3 different swatches) are averaged together and the average voltages for the four different fabrics are averaged to obtain the static number. The lower the static number, the better is the antistatic performance of the cleaning composition. Generally static numbers of less than about 5 kilovolts (KV) are considered very good and are perceived by the consumer as absence of static buildup.

TABLE A

| Sample | QUAT (gm/wash) | Ethoxylated Amine (gm/wash) | Sliding Scale Softness No. | Static No. |
|---|---|---|---|---|
| 2B (comparison) | 3.96 | — | 8 | 2.8 KV |
| 2A (invention) | 3.62 | 0.34 | 8 | 4.2 KV |

In a side-by-side softness comparison test, Sample 2B received eleven first place votes (35 points) as compared to 13 first place votes (37 points) for Sample 2A.

EXAMPLE 3

Example 1A is repeated except that the mixture of dimethyl distearyl ammonium chloride, tallow amine adduct with 15 moles ethylene oxide, calcium silicate and water is stirred and fed to the inlet of a soap-plodder extruder where it is extruded in the form of spaghetti or noodle. When the spaghetti or noodle is added to the spray-dried detergent shown in Example 2 similar results to those of composition 2A are obtained.

EXAMPLE 4

Example 1A is repeated except that in place of Ethomeen T/25, the following ethoxylated tertiary amines are used:

(a) polyoxyethylene (5) octadecylamine
(b) polyoxyethylene (5) tallow amine
(c) polyoxyethylene (10) tallow amine
(d) polyoxyethylene (15) tallow amine
(e) polyoxyethylene (5) hydrogenated tallow amine
(f) polyoxyethylene (15) hydrogenated tallow amine.

EXAMPLE 5

To a spray dried detergent composition having the following approximate analysis

| Component | Weight % |
|---|---|
| Linear dodecyl benzene sulfonate | 23 |
| $Na_2CO_3$ | 20 |

-continued

| Component | Weight % |
|---|---|
| Na silicate | 15 |
| Borax | 3 |
| $C_{12}$-$C_{15}$ fatty alcohol with 7 moles ethylene oxide (Neodol 25-7) | 3 |
| Carboxymethyl cellulose | 1 |
| Optical brightener | 0.5 |
| Satintone | 1 |
| $Na_2SO_3$ and water | q.s. 100 |

is added 4% of the cationic softener/ethoxylated amine softener-dipsersant of Example 1A. Excellent detergency and softening performance is obtained.

EXAMPLE 6

4.5 grams of the cationic softener/ethoxylated amine powder of Example 1A is post-added to the spray-dried detergent powder of Example 2. Further improvements in softening are provided (sliding scale softness number: 9-10).

The following examples illustrate the production and use of the cationic-nonionic combination in prilled form.

EXAMPLE 7

Five hundred kilograms of dimethyl distearyl ammonium chloride containing about 4% water is heated to 90° C. and forms a melt. To this hot melt are added 25 kilograms of Ethomeen T/25. This comelt is then sprayed downwardly from the top of a 75-foot (about 24 meters) tower of 16 foot diameter (about 5 meters). At the same time cool air at about 50° F. (10° C.) is passed upwardly (i.e. countercurrent to the falling spray) at a rate of about 30,000 cubic feet per minute (cfm). The congealed product is collected at the bottom of the tower. The product particle is white in appearance, free-flowing, generally spherical and solid. It has a porous surface (pock-marked appearance). The bulk density of the prill is about 0.37 (g/cc).

EXAMPLE 8

To 95.5 g of the detergent of Example 2 (without Example 1A particles) are added 4.0 or 4.5 g of the prills of Example 7.

EXAMPLE 9

Each of the previous examples is again repeated except that the cationic softener of the cationic-ethoxylated amine mixture is replaced by the following:

(a) dimethyl di-tallow ammonium methosulphate;
(b) dimethyl, di-hydrogenated tallow ammonium chloride;
(c) 1-methyl-1-tallow amido ethyl-2-tallow imidazolinium methosulphate;
(d) 1-methyl-1-oleylamidoethyl-2-oleyl imidazolinium methosulphate.

What is claimed is:

1. A particulate detergent softener composition capable of imparting improved softness, detergency, antistatic and soil antiredeposition properties to fabrics treated therewith in a laundering process comprising by weight from about 5 to 40% of water soluble non-soap, anionic organic surfactant, from about 10 to 60% of water soluble, neutral to alkaline builder salt, and substantially homogeneously dispersed in said composition as discrete particles an intimate mixture of (i) a cationic amine softener in an amount from about 2 to 20% by weight of the total composition with (ii) a water soluble ethoxylated tertiary amine dispersant/softener compound of the formula

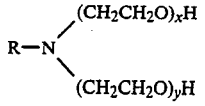

where R is alkyl or alkenyl having from about 8 to about 22 carbon atoms, and x and y are positive numbers such that the sum x+y is from about 2 to about 15, the percent concentration of anionic surfactant being at least about 1.5Cs+5, Cs representing the percent concentration of total softener (i) and (ii).

2. A composition according to claim 1 wherein R is $C_{16}$–$C_{18}$ alkyl.

3. A composition according to claim 1 wherein R is stearyl, cetyl, tallow, hydrogenated tallow or mixtures thereof.

4. A composition according to claim 1 wherein R is $C_{10}$ to $C_{20}$ alkyl or alkenyl and x+y is from about 5 to 15.

5. A composition according to claim 1 wherein the amount of the ethoxylated tertiary amine (ii) is from about 2 to 50% by weight of the mixture of (i) and (ii).

6. A composition according to claim 1 wherein the amount of the ethoxylated tertiary amine is from about 2 to 20% by weight of the mixture (i) and (ii), said mixture comprising from about 2 to about 15% of said composition.

7. A composition according to claim 1 wherein the ethoxylated tertiary amine comprises from about 2 to 15% by weight of the cationic amine (i)/ethoxylated tertiary amine (ii) mixture, and said mixture comprises from about 2 to about 10% by weight of the composition.

8. A composition according to claim 1 in which the said cationic mixture is the finely ground product of a comelt of the cationic and ethoxylated amine components.

9. A composition according to claim 1 in which the cationic ethoxylated amine mixture is a prill.

10. A composition according to claim 9 in which the said prill is a generally spherical, porous-surfaced solid cored particle.

11. A composition according to claim 1 in which the cationic amine (i) is a di-short chain alkyl, di-long chain alkyl quaternary ammonium halide or an imidazolinium compound.

12. A composition according to claim 1 in which the cationic amine softener (i) is a di $C_1$ to $C_4$ alkyl, di$C_{14}$ to $C_{18}$ alkyl ammonium halide and the said ethoxylated amine is a $C_8$ to $C_{18}$ linear aliphatic tertiary amine containing from about 2 to about 15 moles of ethylene oxide.

13. A composition according to claim 1 in which the cationic amine softener is selected from the group consisting of di $C_1$ to $C_4$ alkyl, di $C_{14}$ to $C_{18}$ quaternary ammonium salts, imidazolinium salts and mixtures thereof and the ethoxylated amine is a $C_{12}$ to $C_{18}$ linear aliphatic tertiary amine containing from about 5 to about 15 moles of ethylene oxide.

14. A composition according to claim 1 in which the non-soap detergent comprises an alkyl benzene sulphonate, and the builder comprises a phosphate.

15. A composition according to claim 14 in which the non-soap detergent is a $C_8$ to $C_{18}$ linear alkyl benzene sulphonate.

16. A composition according to claim 1 in which the non-soap detergent comprises a $C_8$–$C_{18}$ linear alkyl benzene sulphonate, the builder comprises a phosphate, the cationic amine (ii) is a di $C_1$ to $C_4$ alkyl, di $C_{14}$ to $C_{18}$ alkyl ammonium halide, the ethoxylated amine (ii) is a $C_{12}$ to $C_{18}$ linear, tertiary amine containing from about 5 to about 15 moles of ethylene oxide and the said ethoxylated amine comprises from about 3 to about 10% by weight of the said cationic softener/ethoxylated amine mixture.

17. A process for preparing a composition according to claim 1 which comprises spray drying the non-soap organic surfactant and builder salt and, to the spray-dried material, post adding the discrete particles.

18. A substantially dry particulate softener composition comprising an intimate mixture of a cationic amine softener and from 2 to 20% based on the weight of the said mixture of water-soluble nonionic ethoxylated tertiary amine softener-dispersant compound of the formula

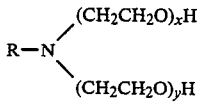

where R is alkyl or alkenyl having from about 8 to about 22 carbon atoms, and x and y are positive numbers such that the sum x+y is from about 2 to about 15.

19. A process for washing fabrics comprising contacting said fabrics in an aqueous medium at a temperature of from about 80° to 170° F. with sufficient of the composition of claim 1 to provide a ratio of from 1.5 to 3.5 g of softener per 3500 g of fabric.

* * * * *